United States Patent [19]

Mauch

[11] Patent Number: 4,760,393

[45] **Date of Patent: * Jul. 26, 1988**

[54] SECURITY ENTRY SYSTEM

[75] Inventor: Barbara J. Mauch, Inglewood, Calif.

[73] Assignee: Marlee Electronics Corporation, Inglewood, Calif.

[ * ] Notice: The portion of the term of this patent subsequent to Jan. 26, 2005 has been disclaimed.

[21] Appl. No.: 844,657

[22] Filed: Mar. 27, 1986

Related U.S. Application Data

[63] Continuation-in-part of Ser. No. 811,962, Dec. 18, 1985, Pat. No. 4,721,954.

[51] Int. Cl.[4] ..... E05B 49/00; G08B 19/00

[52] U.S. Cl. ..... 340/825.310; 340/825.560; 70/278; 361/172

[58] Field of Search ..... 340/825.31, 825.56, 340/825.32, 541, 542, 543; 361/171, 172; 70/277, 278

[56] References Cited

U.S. PATENT DOCUMENTS

| | | | |
|---|---|---|---|
| 3,622,991 | 11/1971 | Leher et al. | 70/278 |
| 3,754,213 | 8/1973 | Morroni et al. | 361/172 |
| 3,838,395 | 9/1974 | Suttill, Jr. et al. | 340/825.31 |
| 3,842,629 | 10/1974 | Pazer et al. | 340/825.31 |
| 3,953,769 | 4/1976 | Sopko | 340/825.31 |
| 4,148,092 | 4/1979 | Martin | 361/172 |
| 4,218,690 | 8/1980 | Ulch et al. | 340/825.31 |
| 4,532,507 | 7/1985 | Edson et al. | 340/825.56 |

*Primary Examiner*—Donald J. Yusko

*Attorney, Agent, or Firm*—Nilsson, Robbins, Dalgarn, Berliner, Carson & Wurst

[57] ABSTRACT

A system for securing a building complex incorporating a plurality of lockable access locations, including a keypad-operated remote unit at each access location coupled for communication with a control station through a communication network. Access locations are room doors, as of a hotel or an apartment building and the remote units are grouped by floor, each floor having a sub-controller to relay messages and perform control functions. The control station includes a desk unit with a keypad for entering floor-related access code information as chosen by a guest and a separate keyboard for assignment of a room number by a desk clerk which addresses a remote unit. Access codes are stored at remote units located at the assigned rooms so that a room can be unlocked only by manual entry of the proper access code on a keypad of the remote unit. Each remote unit functions independently to open a door associated with it and remains operable even if other portions of the system malfunction. Status data reports and automatic controls are also implemented. Suspicious patterns at the access units are detected, both with respect to individual units and groups of units. Security action is taken on the occurrence of suspicious or threatening patterns, as repeated failures at individual or multiple access units.

6 Claims, 4 Drawing Sheets

20
19
18
10
11
DS
CS
12
14
DESK STATION
CENTRAL STATION UNIT
• CONTROLLER
• ACTIVITY LOG
COMMUNICATION UNIT
16
21
COMMUNICATION SYSTEM
CU
32
FLOOR FA
FLOOR FB
L1
24
18
38
23
REGISTER
ACCESS UNIT A2
ACCES UNIT A3
26
COMPARATOR
LOCK
27
MONITOR
22
ACCESS UNIT A1
L2
ACCESS UNIT B1
ACCESS UNIT B2
ACCESS UNIT B3

SECURITY ENTRY SYSTEM

RELATED SUBJECT MATTER

This is a continuation-in-part of application Ser. No. 811,962 filed Dec. 18, 1985 entitled "Keypad Security System" now U.S. Pat. No. 4,721,954.

BACKGROUND OF THE INVENTION

The present invention relates generally to the field of security access systems and, more particularly, to a computerized cost effective entry control system which provides high levels of security, convenience and flexibility.

Individual push-button operated locks have been used to secure doors of dwellings as well as vehicles. Such locks are described in U.S. Pat. Nos. 3,953,769; 4,149,212; and 4,477,806, each of which discloses a stand-alone push-button lock programmed at the location of the lock to respond to an access code.

The only push-button system known to the present inventor for securing a large number of access locations was manufactured by Tool Research Engineering of Santa Ana, Calif., under the name "Digikey". The Digikey system has a keypad at access locations with no local storage or processing capabilities. The keypads are connected together as an operating unit by a large number of wires leading to a central control computer.

In the Digikey system, a four-digit number entered on a keypad at the access location is transmitted to the central computer which determines whether the number is a valid access code. If the number is valid, a signal from the computer unlocks the door. In a hotel installation, the valid access code is chosen by a guest when he checks in. To do so, he enters a four-digit number on a keypad at the front desk. The number is then stored in the central computer at the front desk for subsequent use in opening the door. As far as applicant is aware, there is no provision in the Digikey system for deviating from a four-digit entry code, and only one code can be stored for each room.

Other systems for controlling accesses in large building complexes involve the use of machinereadable "card keys" which may or may not resemble mechanical keys. Such devices are described in U.S. Pat. Nos. 3,622,991; 3,694,810; 4,157,534 and 4,415,893. The use of physical keys of any type involves some disadvantages. While some of the physical key systems disclosed in the patents above have storage and comparison capabilities at each controlled access, many are cumbersome in their implementation. For example, the devices of U.S. Pat. Nos. 3,622,991 and 4,157,534 require extensive hardwire networks or microwave transmission devices for communication. U.S. Pat. No. 4,415,893 is somewhat distinct in stressing the desirability of retaining the mechanical parts of a conventional door lock, with the pin tumbler replaced by an electronic reading cylinder of identical size. This is proposed for the purpose of maintaining the "feel" of a mechanical lock. The patent clearly teaches away from the development of a keyless system.

To some extent, keyless systems isolate the locking mechanism from direct manipulation by an unauthorized person; however, other problems arise. Specifically, the problems of electronic meddling or tampering at various levels are introduced. In that regard, with the widespread use of portable computers, it may be a relatively simple matter for an unauthorized person to couple a computer to an electronic access control system. That likelihood becomes a particularly significant problem with regard to a data-bus system as contemplated by the present invention. Accordingly, a considerable need exists for an economical access control system that is expedient to install, effective in operation and relatively safe with regard to the host of possible techniques for an improper entry. The need is complicated in installations as hotels where access by service and cleaning people must be accommodated and halls are freely accessible to all persons. Additionally, persons authorized to enter rooms change daily and must be accommodated rapidly during a brief contact as at the front desk of a hotel.

SUMMARY OF THE INVENTION

The present invention relates to a system for securing a building complex, e.g. a hotel, having a control or desk location and a plurality of lockable access locations, including at least one control station, located for example at a hotel front desk. The desk station communicates with remote access units at the access locations (doors) by an address bus. As disclosed, each remote access unit is somewhat independent, having a keypad, a memory and a testing capability. A network bus enables bidirectional communication between the desk station and the remote access units. Communication is with data words that normally indicate an address code (specifying destination) and an access code. A communication bus transmits data words to store access codes at designated locations, i.e. a remote station access unit.

In operation, the keypad at a remote station is actuated to develop an entry access code which is compared with the stored test access codes at the remote station. With a favorable comparison, an entry signal is formed to unlock the access door.

In the disclosed embodiment, addressed access codes are routed in serial-message data words (including address data) and are transmitted over split data buses to and from remote stations. The remote stations are divided into groups (by floor) with a separate common apparatus for each group. Each group apparatus is responsive to those messages which designate it. Each group control apparatus also monitors the status and activity at the access units to which it is assigned and may disable one or more of the stations upon detection of a threatening activity pattern.

BRIEF DESCRIPTION OF THE DRAWINGS

The above and other features of the present invention may be more fully understood from the following detailed description, taken together with the accompanying drawings, wherein similar reference characters refer to similar elements throughout and in which.

DESCRIPTION OF THE DISCLOSED EMBODIMENT

Figure 1:
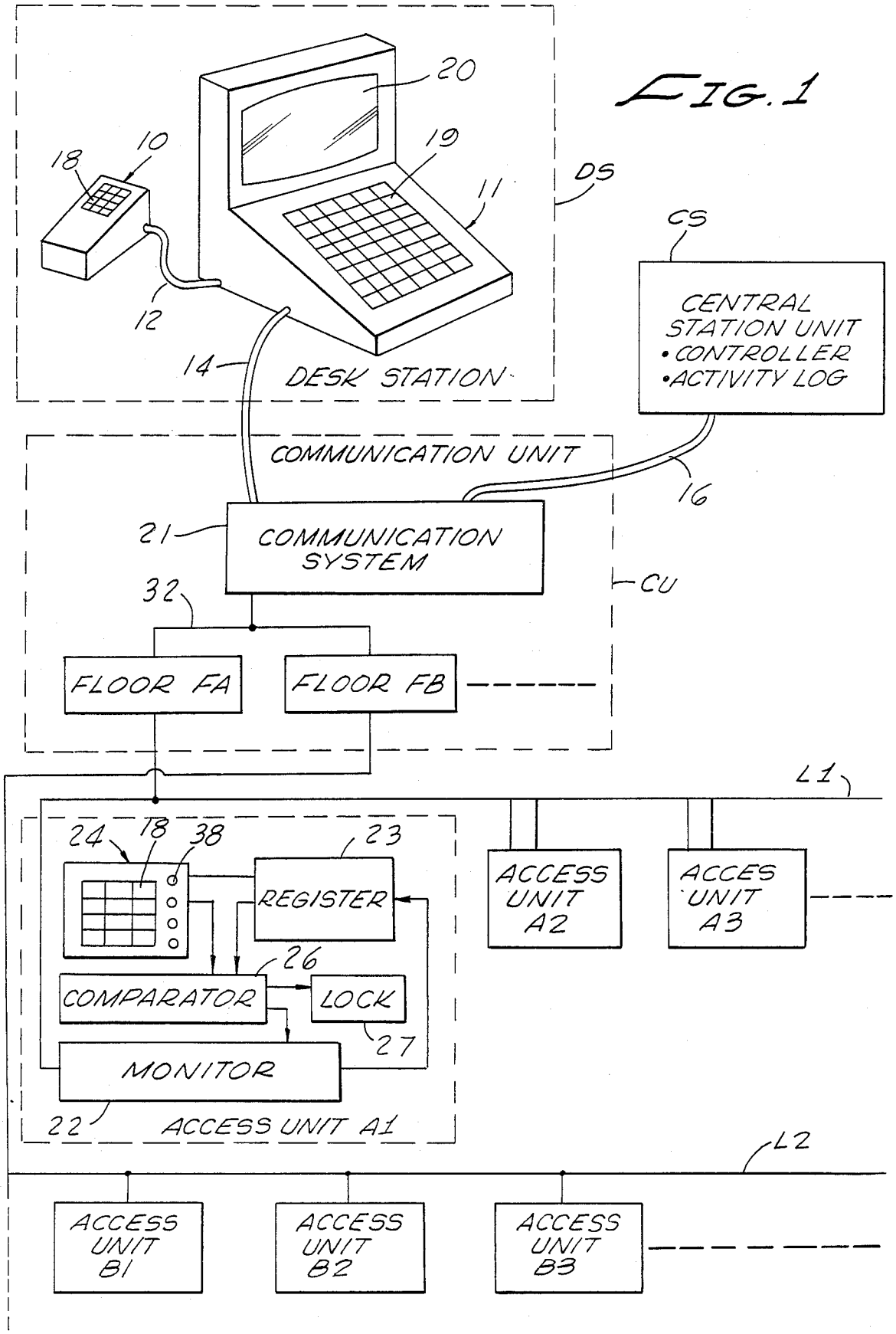
FIG. 1 is a block and pictorial diagram depicting a system constructed according to the present invention.

Referring initially to FIG. 1, the components of the system are represented somewhat as they are physically located at an installation, as for example in a hotel. That is, the system is described in an installation for securing guest rooms in a hotel. However, the applicability of the system to other building complexes will be apparent, specifically apartment buildings, industrial complexes, government installations and so on.

In the system as represented in FIG. 1, a desk station DS is located at the front desk of a hotel for cooperative use by arriving guests and a desk clerk. The desk station DS is connected through a communication unit CU to access units located at the individual hotel rooms. The access units are similar, comprising structure as illustrated in some detail in an access unit A1 (lower left). The access units carrying a designation A1, A2, A3 and so on are located in one floor group while access units B1, B2, B3 and so on are located in another floor group. Thus, the alphabetic designation letter indicates the floor group for each access unit.

As indicated in FIG. 1, a large number of individual access units normally will be involved in an installation. As described in detail below, the access units of each floor are grouped together and function as groups somewhat independently through the communication unit CU.

In operation, actions jointly performed at the desk station DS by a guest and the desk clerk formulate and register an access code in the access unit located at the room assigned to the guest. Generally, the registered access code is known only to the guest.

To enter his assigned room, the guest actuates the access unit with his access code to form representative signals that are compared with representations of the registered test access code. On coincidence, the door is released or unlocked.

As disclosed in detail below, the system also permits access to individual rooms by service and cleaning personnel as well as management. Specific access codes are registered at the access units for use by hotel personnel. Such use may be restricted to specific hours of the day.

The system also incorporates structure for detecting threatening patterns that suggest misconduct or skullduggery at the access units. With the occurrence of a threatening pattern, various actions may occur. Such patterns may alert management personnel or may secure an individual room or a block of rooms as with a "lock-out" for a time.

In accordance with the operation of the system, a detailed activity log is maintained in the form of data on individual incidents at access units. In that regard, a central station unit CS (upper right) includes computing capability along with memory for the activity log. Vacated rooms also may be cleared of guest access codes from the central station unit CS.

Preliminary to considering the system of FIG. 1 in somewhat greater detail, the following chart of signals is provided as a reference for signal designations used herein.

| Designation | Signals Description |
|---|---|
| asterisk sign (*) | Start access code entry |
| numeral sign (#) | End access code entry |

-continued

| Designation | Signals Description |
|---|---|
| El-En | Comparison approval |
| T | Time of day |
| LO | Lock out - seal entry |
| RE | Re-enter - panel signal |
| AC | Accepted - panel signal |
| RD | Ready - panel signal |
| WA | Wait - panel signal |
| 0 | 0 number |
| 1 | 1 number |
| 2 | 2 number |
| 3 | 3 number |
| 4 | 4 number |
| 5 | 5 number |
| 6 | 6 number |
| 7 | 7 number |
| 8 | 8 number |
| 9 | 9 number |
| A | * instruction |
| B | # instruction |
| C | Non-digit |
| D | Impossible digit |
| NA | No access, results from lack of favorable comparison |
| GO | Door open signal |

In the system of FIG. 1 the desk station DS incorporates a small keypad 10 and a desk terminal 11. The two are interconnected by a cable 12. The desk terminal 11 is also connected to the communication unit CU by a cable 14. A cable 16 interconnects the communication unit CU and the central station CS. Generally the desk terminal 11 and the central station unit CS may comprise similar structures. Specifically, they may take the form of a personal computer as an Epson HX or an IBM PC. Note that physically, the central station unit CS and the communication unit CU are interconnected.

The keypad 10 includes a numeric keyboard 18 which may take the form of a conventional push-button telephone array with twelve buttons designated with the numerals 0 through 9 and the symbols asterisk (*) and number sign (#). The disclosed embodiment employs a hexidecimal signal format wherein a standard code represents the numerals 0 through 9, A, B, C and D.

| Code | Decimal Number | Representation |
|---|---|---|
| 0000 | 0 | 0 number |
| 0001 | 1 | 1 number |
| 0010 | 2 | 2 number |
| 0011 | 3 | 3 number |
| 0100 | 4 | 4 number |
| 0101 | 5 | 5 number |
| 0110 | 6 | 6 number |
| 0111 | 7 | 7 number |
| 1000 | 8 | 8 number |
| 1001 | 9 | 9 number |
| 1010 | A | * instruction |
| 1100 | B | # instruction |
| 1101 | C | Non-digit |
| 1110 | D | Impossible digit |

The signal representations for 0-9, (*) (A) and (#) (B) can be produced at the access unit. However, the signal representations for (C) and (D) may not be so produced. The utilization of the signals C and D is treated in detail below.

The desk terminal 11 incorporates a full computer keyboard 19 and a CRT display 20. The keyboard 18 of the keypad 10 is used by an arriving guest to enter his personally selected access code which is registered at the access unit of his assigned room. The desk clerk uses the keyboard 19 for entering the number of the room assigned to the guest along with appropriate guest information and control data. The assigned room number serves (directly or indirectly) as an address for communicating the access code to the access unit of the assigned room. Accordingly, the access code selected by the guest is passed through the communication unit CU to a communication bus, e.g. L1 or L2, from which it is accepted by the designated access unit.

To consider an operating example, assume a guest uses a number significant to him as his access code, e.g. "2478613". Also assume the guest is assigned the room number "101", associated with the access unit Al which is shown in FIG. 1 in some detail. Proceeding from those assumptions, a data word is formulated in the desk terminal 11 including the room number "101" and the access code number "2478613". The data word is transmitted through the cable 14 to a communication system 21, then through the floor unit FA to a serial bus L1. Note that the communication unit CU incorporates a floor unit for each group of access units collected by floors, e.g. floor units FA, FB, and so on.

The appearance of a data word addressed to the access unit A1 on the bus L1 is detected by a monitor 22 located in the access unit A1. The monitor 22 identifies an address ("101") as designating a data word for the access unit A1 and accepts the data from the bus L1 to store the access code in a register 23.

With the selected access code stored in the register 23, the guest can unlock the assigned room by freshly entering the assigned access code ("2478613") using a keypad 24 at the access unit A1. Specifically, access codes entered at the keypad 24 are compared with test access codes held in the register 23. Both are applied to a comparator 26 and upon coincidence, the comparator 26 releases a lock 27. The monitor 22 then reports the occurrence of that event by formulating a data word which is communicated for registration in an activity log of the central station unit CS. Specifically, a data word is communicated by the bus L1, the floor unit FA, the bus 32, the communication system 21 and the cable 16 to the unit CS.

Note that in the operation of the system, the controlled access or door (not shown) associated with the access unit A1, and specifically the lock 27, can be released only by a person entering a proper access code at the keypad 24.

As explained above, the apparatus of the desk station DS and the central station CS are in bidirectional communication with the access units, e.g. units A1, A2, A3 as well as units B1, B2, B3 and so on. Such communication is by address-bearing data words communicated on data buses as well known in the prior art. However, in spite of such communication the central control facilities are not able to unlock the doors. That operation can be accomplished only at the individual access units. Furthermore, with a proper access code inserted, each access unit is capable of unlocking a door independently of the remainder of the system. Each access unit relies on its own memory and need not communicate with other components of the system to actuate the associated lock. Accordingly, security and operation at individual doors may be maintained even if other components of the system fail. It is also noteworthy, as explained in detail below, that access codes can be set in the register 23 to incapacitate the keypad 24 from forming the requisite access code.

As indicated above, communication with access units involves the buses L1, L2 and so on which receive data words incorporating an address for the designation in accordance with well known computer bus techniques. In that regard, data words are formulated by the desk terminal 11, the control station CS and each of the access units. Specifically for example, data words are formed in the monitor 22 of access unit Al. The formulation of such data words is treated in detail below; however, consideration will now be directed to the data word formats as illustrated in FIGS. 2A and 2B.

Figure 2A:
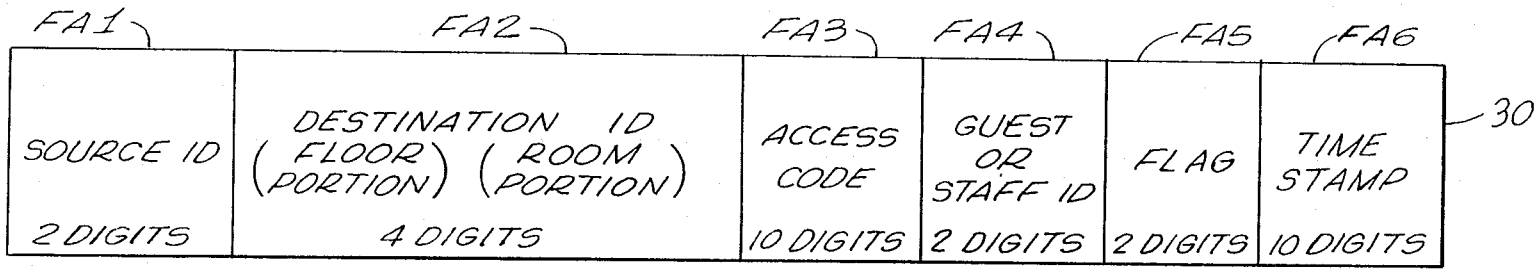
FIGS. 2A and 2B are representations of data word formats utilized in the system of FIG. 1.
Figure 2B:
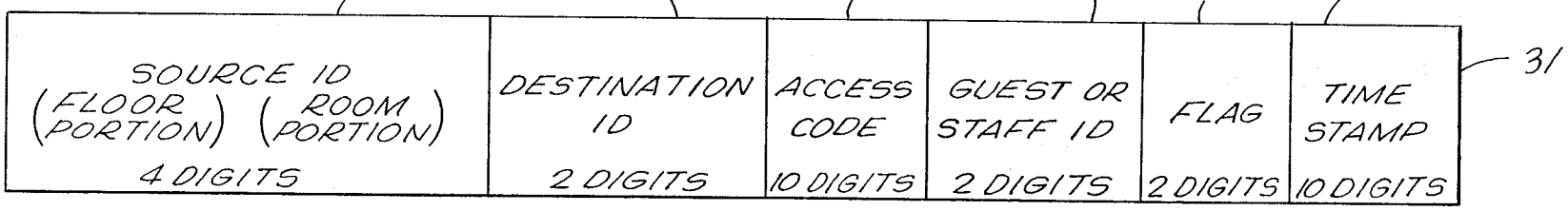

FIG. 2A illustrates the format for data words that are addressed to individual access units. FIG. 2B illustrates the format for data words that are generated at the access units to report a specific operation or pattern. Such words may be addressed to the associated floor unit, the central station unit CS or the desk station DS.

In most installations, it is likely that primarily communications to the access units (FIG. 1) will be to register an access code, as for a fresh guest. Likewise, presumably most communications from access units will be to report a door was opened at a specific time using a specific access code. That information is placed in the memory of the central station unit CS to constitute the activity log. Of course, other important communications will be expected to occur from time to time.

Considering FIG. 2A, an illustrative data word 30 is represented to include a number of specific fields as follows:

| Field | Data | Digits |
|---|---|---|
| FA1 | Source address identification | 2 |
| FA2 | Destination address identification | 4 |
| FA3 | Access code | 10 |
| FA4 | User code (e.g. guest or staff) | 2 |
| FA5 | Flag code | 2 |
| FA6 | Time | 10 |

The somewhat similar data word 31 formualted at the access units is illustrated in FIG. 2B and includes individual fields as follows:

| Field | Data | Digits |
|---|---|---|
| FC1 | Source address identification | 4 |
| FC2 | Destination address identification | 2 |
| FC3 | Access code | 10 |
| FC4 | User code | 2 |
| FC5 | Flag code | 2 |
| FC6 | Time | 10 |

In the disclosed embodiment, the digits are hexidecimal as indicated in the above chart as represented by the numerals: 0, 1, 2, 3, 4, 5, 6, 7, 8, 9, A, B, C and D. The numerals A and B are manifest as instruction digits signaled by an asterisk (*) or a number sign (#). The numerals C and D have special purposes as will now be considered.

The fields FA3 and FC3 for accommodating access codes may constitute from four to ten hexidecimal digits. Consequently, the guest is afforded flexibility in his selection of an individual access code. For access codes of less than ten digits, signal representations for the numeral C are inserted automatically by the keypad 24 to fill the unused digits. For example, a selected access code of "2478613" would be signal represented as a ten-digit code "CCC2478613", the initial digits "C"

actually being non-digits which designate unused digit locations.

The fields FA4 and FC4 identify the uses involved or special codes for certain data words, along with the flag fields FA5 and FC5. The time stamp fields FA6 and FC6 manifest Julian clock values and are provided by any of several clocks in the system as disclosed below.

The data words 30 are formulated in the desk terminal 11 or the somewhat similar central station CS which, as indicated above, incorporate a microprocessor. Essentially, data words are formulated or generated at various locations in the system using well known techniques of the prior art. Data words simply may be compiled in a hexidecimal register as illustrated in FIGS. 2A and 2B, then stepped from the register in a serial format. Parallel data paths are also employed. Thus, with respect to the word of FIG. 2A as formed in the terminal 11 (FIG. 1), the format is generated in a buffer register by control functions and data entry performed on the keyboard 19. Again, note that the field FA3 (access code) is developed by the guest using the numerical keyboard 18 on the keypad 10.

Thus, in accordance with operations well known in the prior art, a code key on the keyboard 19 may be actuated to indicate a command for forming the data word 30. Specifically, with the command, the source address identification is drawn from a table storage and entered in field FAl (FIG. 2A). Using the keyboard 19, the operator indicates the destination address identification which is set to occupy the field FA2 in the compiling register. A look-up table may be involved. Next, the operator actuates a key in the desk terminal 11 to receive the access code from the keypad 10. In the illustrative embodiment format, the guest is requested to strike the asterisk (*) button followed by the digits of his access code which is then followed by the number symbol (#) key. Representative signals are provided from the keypad 10 to the desk terminal 11 for registration as the field FA3 of the data word.

The operator (desk clerk) uses the keyboard 19 to identify the user, e.g. guest or staff, which data is registered as FA4 and a flag is provided to indicate various circumstances, for example, that the access code is being assigned to a guest.

To terminate the word-generation operation, the operator actuates a code key prompting the registration of the time as the field FA6.

Signals representative of the composed data word pass from the desk terminal 11 (FIG. 1) through the cable 14 in a serial fashion to the communication system 21. A bus 32 from the communication system 21 supplies the data word 30 to each of the floor units FA, FB and so on. The data word is accepted by the designated floor unit (address of field FA2), registered and passed on to the appropriate bus for an access unit. Specifically for example, if the floor unit FA is addressed, it supplies the code word to the bus L1. Consequently, each of the access units A1, A2, A3 and so on, receives the data word; however, only the specific access unit addressed (field FA2, room portion) accepts the data word. Specifically for example, if the access unit A1 is addressed (FIG. 1), the monitor 22 detects the address in accordance with well known prior-art techniques and accepts the code word in the register 23. Subsequently, from that register, the access code (field FA3) will be supplied to the comparator 26 as a test access code along with a fresh entry access code (generated by the pad 24) to determine whether or not the lock 27 should be released.

In addition to the operations as described above for registering access codes in a floor unit and an access unit, the data word is supplied from the desk terminal 12 to the control station CS where it is registered in the activity log. It is to be noted that the central station unit CS incorporates the same capability to that explained and illustrated for the desk station DS. In that regard, it may be convenient to formulate entry codes for service personnel at the location of the central station unit CS. Such codes may be formed by data words as explained above. As explained below, such codes occupy different portions of the register 23. That is, as explained in detail below, the register 23 contains several access codes designated for use by specific persons and in certain cases designated for use during limited times. Note that the central station unit CS also incorporates control capability for interfacing data of the activity log and clearing access codes of departing guests. Again, details of the unit CS are treated below.

Considering the hierarchy of communication, the floor units FA, FB and so on receive data words on the bus 32 to accept those which are specified (by destination field FA2, FIG. 2A) for the assigned floor. Such data words are then passed on to the access units of the floor. Depending on specific implementations, on receiving a data word, a floor unit may modify or refine the data word, as for compatibility in accordance with well known techniques of the prior art. In any event, a data word is applied to the appropriate floor bus, e.g. bus L1 or L2 from the floor unit.

From the bus L1 for example, the designated access unit, e.g. access unit A1, recognizes its address and accepts the data word to register the access code along with a designation of time use restraints indicated by the fields FA4 and FA5. As explained above with reference to FIG. 1, the access code is set in a register 23. Also, the register 23 incorporates several individual registers for several individual access codes. Those registers have time gates which restrict their effective use to specific times of the day. In that manner, service and housekeeping personnel are accommodated limited access to rooms. The specific designation in that regard is carried by the fields FA4 and FA5 (FIG. 2A).

To review and summarize the operation of the system, assume a situation for the operating sequence attendant the registration of a guest and the subsequent use of his access code. The keypad 18 is positioned for use by the guest while the desk terminal 11 serves the desk clerk. As indicated above, by the two people interacting, a data word is formulated which includes an access code known only to the guest and input through the keypad 10.

On command, the data word is transmitted from the desk terminal 11 to the control station unit CS and through the communication unit CU to the access unit at the assigned room for the guest. As indicated above, the control station unit CS incorporates a substantial memory for a comprehensive activity log.

Assume, for example, that the guest is assigned the room 101 associated with the access unit A1. Accordingly, the individual access code, e.g. "2478613" (actually CCC2478613), selected by the guest is set in the register 23. Accordingly, the guest has the "key" for access to the room.

Moving to the assigned room, the guest actuates the keypad 24 which would normally be mounted in or adjacent to the door jam of the assigned room. Specifically, queued by the signal lights 38, the guest simply keys in the access code as previously explained beginning with the asterisk (*) followed by "2478613" and ending with the number sign (#) to indicate completion.

With the entry of the access code, a representative signal is supplied from the keypad 24 to the comparator 26. The operation commands the register 23 to supply the test access codes to the comparator 26 as described in detail below. Thus, the comparator 26 compares the fresh entry access code with the previously stored test access codes. If a match occurs, the comparator 26 provides a coincidence signal to release the lock 27 and enable access to the room. Concurrently, the access unit A1 actuates the monitor 22 to transmit a "valid entry" message to be logged at the central station unit CS. The message is carried in a data word (FIG. 2B) that identifies the matching access code, states the time and so on.

Recognizing that some selectivity may be exercised in various installations and embodiments, it is generally contemplated that in most systems, every data word formulated in the system will be sequentially stored in memory on the activity log of the central station unit CS.

While most keypad operations at the individual access units are expected to produce a favorable comparison and open the door, unfavorable comparisons are likely to be common. If the entry access code (entered on the keypad 24) does not match any of the test access codes stored in the register 23, an "invalid entry" message is sent to the control station CS through the communication unit CU. That data word contains the attempted access code to enable logic in the control station CS to evaluate a question of whether the entry was merely an honest mistake or resulted from an unauthorized person attempting to enter the room. After a preselected number of invalid entries, or after entries that are deemed dangerous, the central station CS transmits a message inhibiting the access unit. For some patterns of improper entries, several access units may be inhibited. Certain of the inhibiting operations are performed by the floor units FA, FB and so on, as described in greater detail below. Again, such details in specific embodiments and individual installations may vary considerably.

Figure 3:
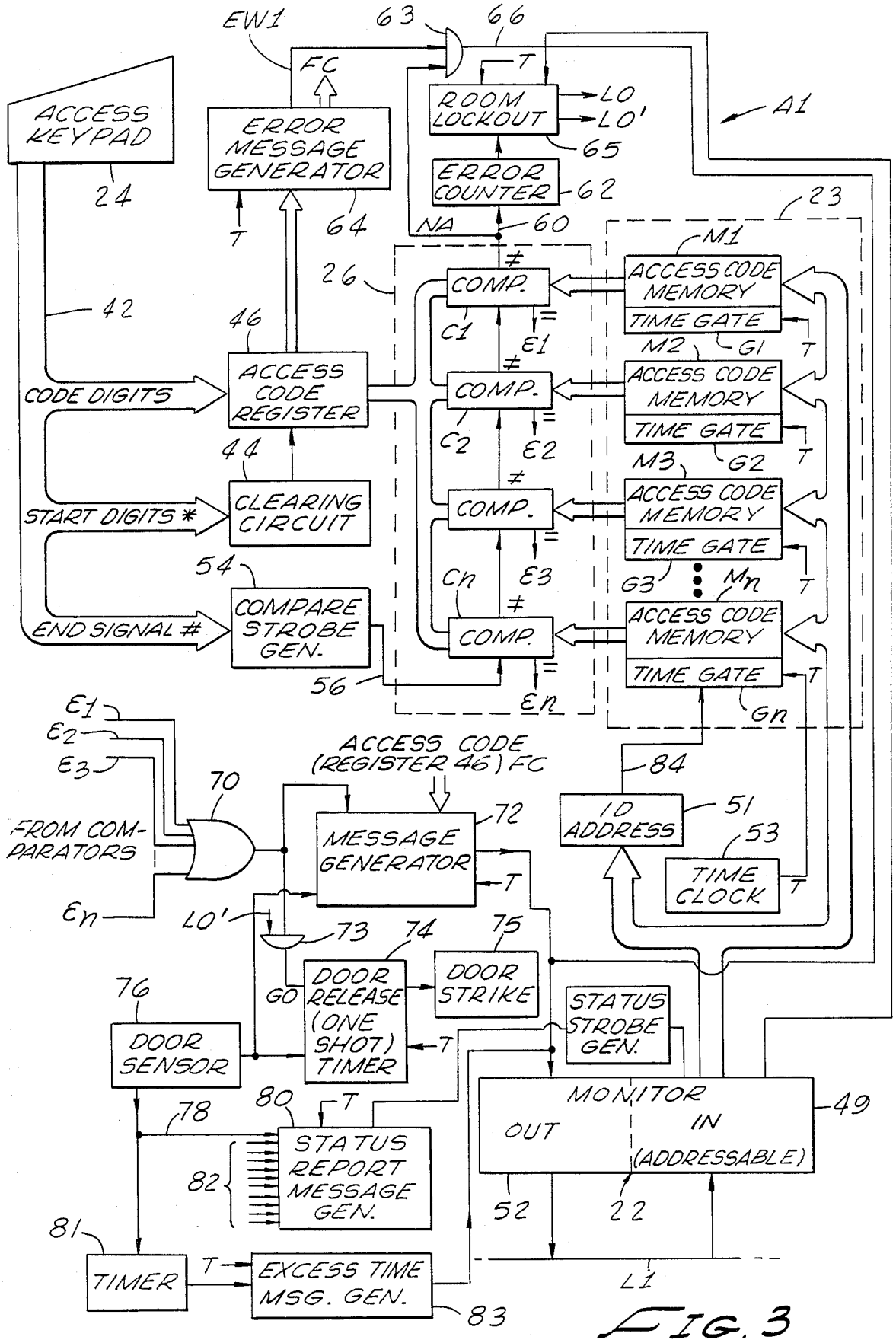
FIG. 3 is a detailed block diagram of an access unit of the system of FIG. 1.

At this point FIG. 3 will be considered to pursue further details of the access units specifically the access unit A1. Initially, it should be understood that the individual access units, e.g. units A1, A2 and so on, may not communicate directly with each other. Rather, the units communicate exclusively through the floor units to the desk station DS and the central station CS. Limited communication is accomplished by restricting the contents of the destination address identification (FIG. 2B, field FC2). For example, data word messages generated by access units for transmission on an associated bus identify the central controller CS as the ultimate designation. As disclosed in greater detail below, the formation of a data word at each of the access units mandatorily designates the control station CS as the ultimate addressee.

Referring to FIG. 3, the detailed structure of a typical room access unit is illustrated. Note that certain elements of FIG. 3 have been described above and bear similar reference numerals. Specifically, the keypad 24 (upper left) is actuated to enter fresh access codes for comparison (in the comparator 26, upper central) with stored test access codes from the memory or register 23 (FIG. 3, upper right) as previously discussed. In FIG. 3, the principal parallel data paths involving these elements are enlarged for distinction from paths for serial binary control and operating data signals.

When a guest actuates the keypad 24 the activity initially prompts the creation of a "start" signal represented as an asterisk (*) which signal is set up for application in parallel to a data path 42 and sensed by a clearing circuit 44 which resets or clears an access code register 46. The access code digits follow, then the end digit (#) is formed.

Following a somewhat instantaneous clearing operation with the start digit (*), the digits of the freshly entered access code from the keypad 24 are supplied to the access register 46. Thus, the access code is set in the register 46 preparatory to a strobe comparison with the previously registered test access codes contained in the register 23. Note that the so-called total register 23 actually comprises memory locations for holding several authorized test access codes. Specifically, access code memories M1 through Mn are illustrated in FIG. 3. At this point, consider some details of the test access codes, their operation and the manner in which the memories M1 through Mn are set to contain those test access codes.

Each of the memories M1—Mn is associated with a time gate G1—Gn respectively. The time gates may limit the hours of the day when test access signals can be supplied from a memory to an associated comparator. In a structural configuration, the time gates G1—Gn may simply comprise a digital gang "and" gate set for qualification at predetermined hours of the day by a time signal.

The code for the registered guest is available for comparison from the memory M1 under control of a time gate G1 during any time of the day. However, the test codes for use by service personnel are available from the memories M2—Mn only during predetermined hours under control of time gates G2—Gn respectively. For example, a maid-service test code in the memory M3 might be used for comparisons only from 9:00 a.m. until 3:00 p.m. under control of the time gate G3. Accordingly, the time gates G1—Gn are coupled to receive timing signals T from a clock 53. Note that the data paths for entering the test access codes in the memories M1 through Mn are described below. Also, it will be recalled that more than one of the memories may be dedicated for the storage of guest access codes. Other memories may be designated for maintenance service, management and so on. Note that, as explained below, attempted use of an access code stored in one of the time restricted memories may signal a caution pattern.

Generally, the memories M1—Mn are set for a specific use and are individually addressed by the fields FA4 or FA5 (FIG. 2A). For example, the memory M1 is used for a test access code assigned to a guest. Specifically, test access codes are received in the memories M1—Mn of the addressed access unit A1 through the bus L1 (FIG. 1, also indicated in FIG. 3, lower right). The bus L1 is connected to the monitor 22 which includes "in" and "out" sections. The "in" section 49 of the monitor may take the form of a structure well known in the prior art for detecting and accepting address-designated data words. The access codes of such data words are then passed into a specific memory through an address unit 51. Thus, the field FA4 (FIG. 2A) is sensed by an address block 51 for an instruction to gate the received access code to a specific one of the memories M1—Mn.

As indicated above, the monitor 22 (lower right) also includes an "out" section 52 which provides data from the access unit back to the central station unit. Essentially, the monitor may take the form of an addressable bus coupling as well known in the prior art of data processing. Its operation in the access unit A1 of FIG. 3 is described in detail below along with other apparatus involved in the receipt, formulation and transmission of data words.

With one or more access codes entered in the memories M1—Mn (all need not be filled), consider the basic comparative operation to test an entered code as generally explained above with respect to FIG. 1. Assume an access code is entered at the keypad 24 (FIG. 3, upper left) designated by a start signal (asterisk "*") and concluded by an end signal (number sign "#"). The start signal (*) is detected by the clearing circuit 44 to purge the access code register 46. The individual digits of the freshly entered access code are then registered in the access register 46. With the occurrence of the end signal (#), a comparison strobe generator 54 (FIG. 3, central) is actuated keying the comparator 26 through a line 56 to sequentially actuate a series of individual comparators C1, C2, C3 and Cn coupled respectively to the memories M1, M2, M3 and Mn. Accordingly, the comparators C1—Cn operate in the reverse order of their designation to individually compare the access codes contained in the register 46 with the contents of the memories M1—Mn.

Upon detecting equality of access codes (entered code versus test code), each of the comparators C1—Cn generates an equality signal E1, E2, E3 or En respectively. The absence of an equality signal from a comparator signals the next comparator in the sequence to act. If none of the comparators detect equality, a binary signal NA is provided at the output from the comparator block 26 to a conductor 60. With the occurrence of the signal NA in the conductor 60, an erroneous or improper entry of an access code is manifest. Conversely, the generation of any of the signals E1—En manifests a successful comparison indicating that the entry access code coincided with one of the test access codes stored in the memories M1—Mn. Note that both events are reported for registration in the activity log of the central station unit CS.

Upon a favorable comparison indicating the determination of a proper code, the access door is released. Upon the determination of an improper code, security measures may be taken, for example a lock-up of the access units thereby sealing the associated entry for a time. Initially, consider the structural elements and operations attendant the failure of coincidence as manifest by the signal NA in the conductor 60.

Access code failures manifest by the signal NA in the conductor 60 actuate an error counter 62 and an error message generator 64. The error counter 62 tallies comparison failures and may be set to various numbers depending on the nature of the installation. When the counted errors reach the predetermined level, the counter 62 provides a signal to a lock-out binary 65 to produce a lock-out signal LO for controlling the access entry. The binary 65 has two states as manifest by signals LO and LO'. The signal LO indicates "lock-out" while the signal LO' indicates "no lock-out". The use of the signal LO' to inhibit striking the door lock is treated in detail below. Note that the room lock-out binary 65 receives a time signal T and can be variously programmed to clear or be reset after a specific interval.

As indicated, signals manifesting an erroneous entry are also supplied to an "and" gate 63 (FIG. 3, top center) which receives the freshly entered access code from the register 46 through an error message generator 64. Consequently, with the failure of an improper access code, that entry access code is passed from the register 46 through the error message generator 64 and the gate 63 to a data path 66 which is coupled to the "out" section 52 of the monitor 22. Accordingly, the improper access code is formulated into a data word (FIG. 2B) by the monitor 22, for return to the activity log in the central station unit CS.

Consider now the alternate course of events which follow a successful comparison of a fresh entry access code and a stored test access code. As indicated above, a successful comparison results in a high level for one of the binary signals E1—En. These approval signals E1—En are applied to an "or" gate 70 (FIG. 3, left central) and to a message generator 72 (FIG. 3, lower central). If any one of the signals E1—En is high, the door associated with the access unit A1 is opened. Accordingly, any one of the signals E1—En in a high state at the "or" gate 70 will qualify an "and" gate 73. If the "and" gate 73 also is qualified by the signal LO' (no lock-out) an actuating signal GO is applied to a door release timer 74. The timer 74 may take the form of a one-shot multivibrator with the consequence that when triggered by a signal GO from the gate 73, a strike signal of timed duration is provided to a door strike 75 releasing the bolt or lock on the door associated with the access unit A1. The door strike 75 is held released for the period of the timer 74, e.g. several seconds. Of course, the door strike may take any of a variety of forms including solenoid actuators.

Note that the "and" gate 73 is qualified by the signal LO' only if the lock-out binary 65 (FIG. 3, upper central) is not set. Thus, the signal LO' in a high state indicates that the room is not in a lock-out state as would occur if a threatening pattern had been sensed.

The access door associated with the access unit A1 also is provided with an "open-shut" sensor 76 (FIG. 3, lower left) A high level binary signal from the sensor 76 is provided to clear or reset the timer 74 when the door is opened. Also, the signal from the door sensor 76 is provided to message generators 72 and 80. Specifically, a conductor 78 from the sensor 76 is coupled to a message generator 80. The conductor 78 also is connected to a timer 81 (delay unit) which is in turn connected to an excess-time message generator 83. The timer 81 is actuated upon receiving a signal that the door has been opened. After the passage of a reasonable period of time, the timer 81 signals the generator 80 to formulate a data word manifesting that the door has been open for an excessive time. Accordingly, the generator 83 formulates a data word that is supplied to the monitor 22 for return to central station unit CS.

As indicated above, a data word also is transmitted to the central equipment from the access unit A1 on the occurrence of a routine door opening. The structure of that operation will now be considered. Specifically, the "or" combination of signals E1—En is applied from the "or" gate 70 to message generator 72 (FIG. 3, lower center) prompting that unit to provide a data word to the "out" section of the monitor 22. Thus, the access code from the register 46 is supplied to the message generator 72 which is actuated by the door sensor 76 to formulate a data word reporting the event of a door opening.

Some general consideration is deemed appropriate with regard to the message generators. In the system-standard access unit A1 as it is depicted in FIG. 3, three message generators 64, 72 and 80 are shown. Of course, these units can be constituted as a single structure; however, they are illustrated in plurality for purposes of explanation. Generally, the structures may take the form of digital stepping registers for receiving parallel signals to provide digits of data words in the format as illustrated in FIG. 2B. The generators may incorporate in permanent storage the field FC1 indicating the access unit A1 as the source identification. Similarly, the field FC2 indicating the destination also may be in permanent storage, e.g. the designation of the central station unit CS. The time signals T from the clock 53 provide the field FC6. Signals representative of the access code are provided from the access code register 46, except for the generator 80 which involves special data words that may or may not include an access code. The generator 80 receives plural inputs 82 as may be variously used to formulate a data word, e.g. access door open for an excessive time.

With the appropriate digits entered in a message generator, the data word is simply stepped therefrom to be serially transmitted through the "out" section 52 of the monitor 22. On the bus L1, the data word passes to an appropriate floor unit, e.g. floor unit F1 (FIG. 1) for transmission through the communication system 21 to the central station unit CS for logging or other action. Thus, the access unit A1 (FIG. 3) stores test access codes for group comparisons with entry codes punched in at the keypad 24. Successful comparisons prompt the release of the access door and are reported. Unsuccessful comparisons are tallied and reported along with other events or patterns that suggest improper activity. Reports are formulated as the activity log in the central station unit CS (FIG. 1).

As explained above, the activity log is recorded in the central station unit CS detailing each of the actions taking place at each of the access units. In addition, threatening patterns that suggest misconduct are reported for logging and possibly action. Of course, the system of the present invention may be accommodated to function in association with any of a wide variety of threatening patterns. It is to be noted that threatening patterns and the prompted security action may involve a single access unit, a group of access units and the associated floor unit or one or more access units functioning in cooperation with the control station unit CS. Exemplary threatening patterns as treated above and suggesting the need for security measures merit some brief further comment.

As explained above, repeated failures to enter a correct access code suggests tampering. Accordingly, the entry door associated with the access unit experiencing such a pattern should be sealed at least for a temporary period. The system may set lock-out times that are related to the number of instances that an improper code is entered. Of course, depending on the nature of the facility, the occurrence of improper codes may also dictate dispatching a security person to investigate the situation.

As explained above, another security situation involves the state of the access door, e.g. open for an excessive period after entry of a guest code. However, it is noteworthy that service and housekeeping people often leave the door open, consequently an open door after the entry of a housekeeping access code probably does not indicate a problem. Also, efforts to enter an access code with the door open may suggest a possibility of devious conduct.

Patterns involving a number of access units may suggest a threat. As an example, consider a case in which a wrongdoer has learned the access code for a room known to be on a specific floor or in a specific area of a floor. With such knowledge, the wrongdoer may move from door to door repeatedly entering the access code in an effort to locate and open one of the doors. The resulting pattern is manifest when a number of doors on a floor or part of a floor receive a similar access code. Various actions can be implemented to respond to such a situation. For example, it may be desirable to "lock up" all doors on the floor for a short period of time. Such actions involve the floor units FA, FB and so on (FIG. 1).

In addition to sensing patterns involving multiple access units, the floor units, e.g. floor unit FA, function as communication relays, buffers and back-ups for individual access units. In that regard, the floor units may store existing access codes for the associated floor as a back-up as in the event of a power failure or loss. Within the purview of the above comments, the floor units may take various structural forms, one of which is illustrated in FIG. 4 and will now be considered.

Figure 4:
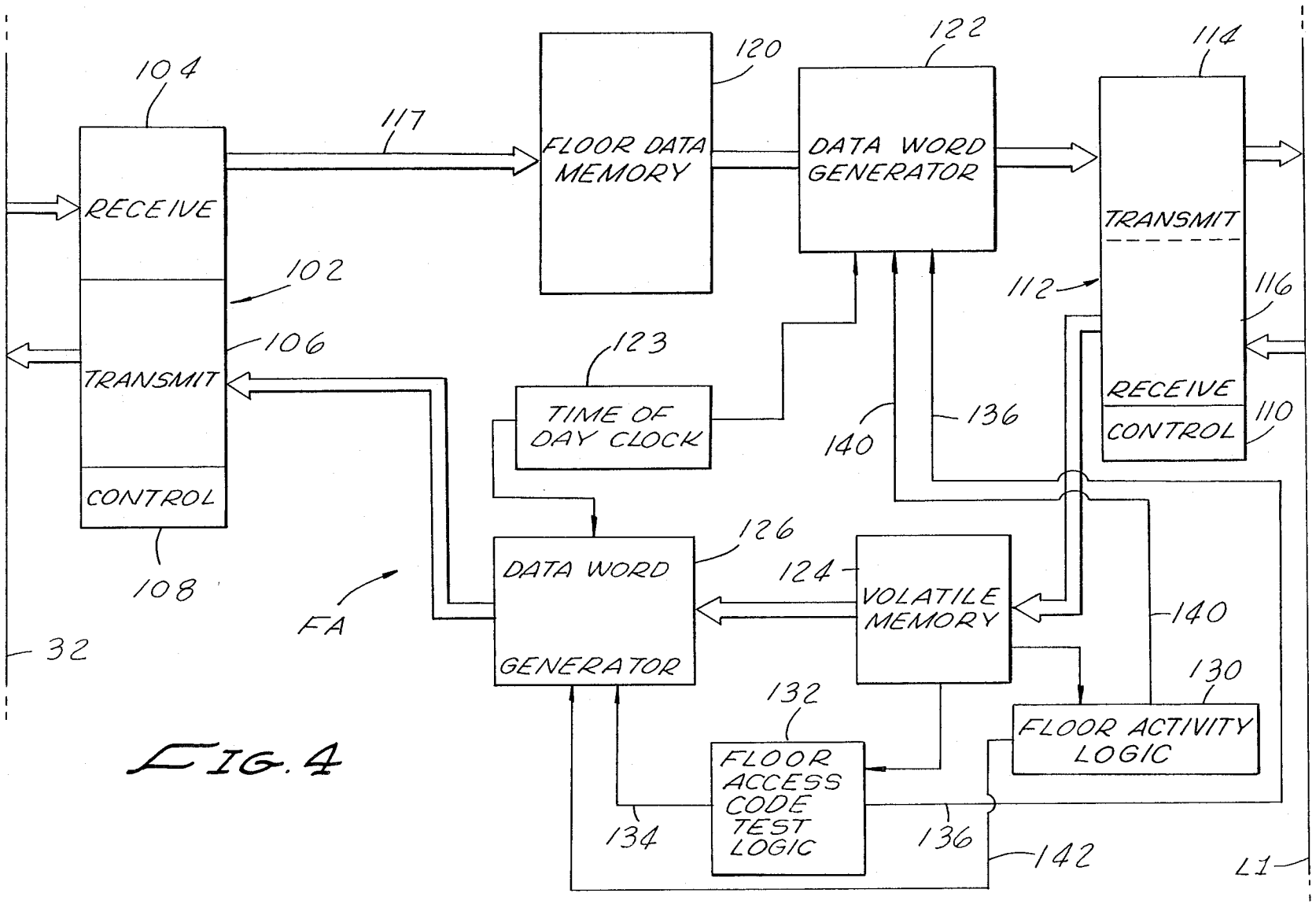
FIG. 4 is a block diagram of a floor unit of the system of FIG. 1.

The floor unit FA as illustrated in FIG. 4 is connected between the buses 32 and L1 (FIGS. 1 and 4). As explained above, the bus 32 is connected to the communication system 21 (FIG. 1) while the bus L1 is coupled to the access units A1, A2 and so on (FIG. 1). Thus, the floor unit FA receives and transmits data words using the buses 32 and L1. The data words accepted by the floor unit FA address that unit in the field FA2 (FIG. 2A). Also data words can be formed by the floor unit FA and carry the floor unit designation as the data word source, i.e. see field FC1, FIG. 2B. Thus, data words transmitted and received by the floor unit FA are in the format as explained above and illustrated in FIGS. 2A and 2B, the words being communicated serially over the data buses as explained above.

Data words passing between the bus 32 and the floor unit FA involve a transmit-receive unit 102 (FIG. 4, left) including a receive section 104, a transmit section 106, and a control 108. The receive section 104 includes an address detector for recognizing data words addressed to the floor unit FA. Both the receive section 104 and the transmit section 106 include signal processing means and are incorporated with the control 108. Generally, the control 108 functions in cooperation with a control apparatus 110 associated with the transmit-receive unit 112 coupled to the bus L1 and including a transmit section 114 and a receive section 116. The transmit-receive unit 112 is generally similar to the transmit-receive unit 102. The controls 108 and 110, though shown distinct, may of course be integrated. The control units 108 and 110 sequence the movement of data words into and out of the floor unit FA as well as controlling internal movements of data and data words therein.

Data words flowing from the bus 32 (FIG. 4, left) pass through the receive section 104 and a parallel path 117 to a floor data memory 120 which is in turn connected to a data word generator 122 that supplies the transmit section 114. Data words moving off the bus 32 are handled by the receive section 104 while data words moving on the bus L1 are accommodated by the transmit section 114.

Recapitulating to some extent, access codes are formulated at the desk station DS (FIG. 1) or in the central station unit CS (FIG. 1) for transmittal on the bus 32 through the communication unit to individual access units. Such information involving access codes is stored in the floor memory 120 then supplied through the data word generator 122 to the transmit section 114 and communicated through the line L1 to the specified access unit. Accordingly, the data words reflecting current access codes for each of the access units are stored in the floor data memory 120 as back-up data. If desired, the data word generator 122 may modify a data word to reflect the time of day when the data word was supplied to the transmit section 114. Accordingly, a time-of-day signal clock 123 is coupled to the data word generator 122.

As explained above, data words also pass from individual access units (FIG. 1) back to the desk station DS and the central station unit CS. Such data words (along with data words destined for the floor unit FA) are carried on the data bus L1 (FIG. 4, right). Specifically, data words formulated in the access units are supplied from the data bus L1 to the receive section 116 for movement to a volatile memory 124. Certain data words are supplied from the volatile memory 124 directly to the data word generator 126 and then to the transmit section 104 for movement to the bus 32. Other data words involve data extracted from the volatile memory 124 and are supplied to the data word generator 126 from a floor activity logic unit 130 or from a floor access code test logic unit 132.

Specifically, data words manifesting routine operations are supplied from the access unit A1 (FIG. 1) through the floor unit FA (FIGS. 1 and 4) without modification or change. As indicated above, such data words simply pass from the bus L1 through the receive section 116, the volatile memory 124, the data word generator 126 and the transmit section 106 to the bus 32. Certain other data words, as those manifesting an error, may result in the development of fresh data words in the generators 122 and 126. Data words developed in the generator 122 are sent through the transmit section 114 back to specific access units. Data words developed in the data word generator 126 are sent through the transmit section 104 and the bus 32 either to the desk station DS or the central station unit CS. Patterns prompting such data words and their generation will now be treated in detail.

One pattern of unusual activity which may prompt security measures involves improper access codes being punched into a series of contiguous access units. For example, an unauthorized person may simply move down a row of doors punching each of the access units with an unapproved access code. While such a pattern is suspicious, it becomes more suspicious if each punched access code is similar. Such a pattern suggests the activity of someone in possession of a proper access code but lacking the knowledge of the specific door for which the access code is proper. Generally, the floor activity logic unit 130 determines such threatening activity at a sequence of adjacent units. The no access signals NA from several access units are stored temporarily in the volatile memory 124. The test logic unit 132 detects repeated use of the same access code at a plurality of access units.

The floor activity logic 130 receives the error signals NA from the volatile memory 124. Such signals are received over an interval of several minutes. During such an interval, the floor activity logic unit performs the logic test for use at plural access units of the same access code. That is, the signals NA (no access) from the access units are monitored logically along with comparisons of the access codes attempted to be used. Accordingly, the occurrence of several failures using the same access code over a short interval of time indicates a cause for possible concern. Such a pattern of signals is detected by the logic 130 to indicate a threat.

The logic 130 may be performed in accordance with any of a wide variety of well known techniques using well known structures to provide a high binary signal when the described event occurs. Such high binary signal is provided to conductors 140 and 142 from the logic unit 130. The signal might indicate that the same erroneous access code has been entered at three adjacent doors. Upon the occurrence of the indicated activity pattern, the binary signals in the conductors 140 and 142 are supplied to the generators 122 and 126. The data word generator 122 formulates an instruction to the next three rooms in the floor sequence to actuate lock-out for a short period of time. For example, if access units A1, A2 and A3 receive improper access codes, such an event is detected by the logic unit 130. Consequently, a data word is formulated by the generator 122 and transmitted to the access units A4, A5 and A6 actuating room lock-out (see lock-out 65, FIG. 3, top center). The system anticipates the movement of an unauthorized person actuating access units and, accordingly, secures the units anticipated to be in the pattern.

The alert signal from the logic 130 to the data word generator 126 prompts the generation of a data word to manifest the suspicious pattern at the central station unit CS. Specifically, the data word is formed in the generator 126 then passed through to transmit section 106, the bus 32 and the communication system 21 (FIG. 1) to the central station unit CS. The resulting manifestation at the unit CS may prompt various activities as an investigation at the scene of the pattern.

The test logic unit 132 (FIG. 4, lower center) detects other suspicious patterns involving multiple access units. The unit 132 monitors other improper access codes from the volatile memory 124 over an interval of time.

Upon such a pattern, a binary signal (high level) is supplied by conductors 134 and 136 (FIG. 4) to the data word generators 126 and 122 respectively. As explained above, upon the occurrence of such a pattern, the data word generators formulate instructions (data words) that are transmitted to the access units and the control station CS. In this instance, the generator 122 may formulate a data word instructing the entire floor to be locked up for a period of several minutes.

The data word formulated in the generator 126 may also be transmitted to the desk station DS or the central control unit CS to inform security personnel who may thus be instructed to inspect the situation or take other action.

Summarizing to some extent, the floor unit FA (as other floor units) isolates the access units and monitors the operation of access units to detect threatening patterns involving a plurality of access units. On detecting such a pattern, action is taken. The floor unit FA also maintains a record of access codes for each access unit on the floor. Information is held on whether each access code is for use by a guest, a staff person and so on. Also, information is held on the time zones for which the access codes are valid. Such data may be drawn from the floor data memory in the event it is necessary to restore data in an access unit or a substantial number of access units.

Note that floor units may also provide status information in response to specific inquiries. In that regard, a data word may be formed at the desk station DS (FIG. 1) or the control station unit CS for transmission through the communication system 21 to the floor unit FA. In the floor unit (FIGS. 1 and 4) the inquiry prompts the floor data memory 120 (FIG. 4, top center) to formulate a reply data word in the generator 122. Such a word is then shifted from the generator 122 through the transmit-receive unit 112 for return to the source of inquiry through the volatile memory 124, the data word generator 126 and the transmit section 106. In one embodiment, an interrogation signal may be generated periodically to log the status of rooms over an extended period of time.

The relationship between the desk station DS (FIG. 1) and the central station unit CS may vary in different installations. In some installations, the central station unit CS might be physically eliminated. However, referring to FIG. 5, an embodiment of the central station unit CS is illustrated. The subsystem is capable of storing guest and staff access codes, receiving and logging information as to the activity and status at the doors controlled by access stations and performing further security operations as lock-outs.

Figure 5:
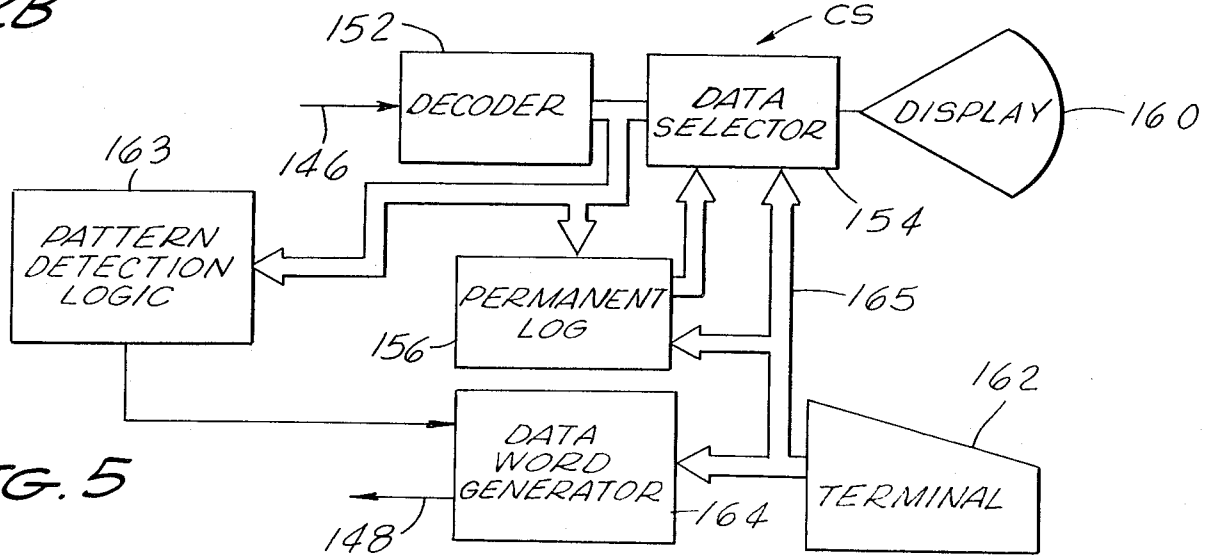
FIG. 5 is a block diagram of a control station unit of FIG. 1.

Communication with the central station unit CS is through a cable 16 (FIG. 1) manifest as conductors 146 and 148 in FIG. 5. While a single conductor may be shared for the serial transmission of signals, in the interests of simplification the conductor 146 is illustrated for the signals to the central station CS and the conductor 148 carries signals from the unit.

The central station unit CS (as the desk terminal 11) is embodied as a minicomputer. However, for purposes of explanation, distinct elements of the unit are illustrated in FIG. 5 as separate components.

Input signals received from the conductor 146 are applied to a decoder 152 for supplying data words to a data selector 154, a permanent log 156 and pattern detection logic 163. Data words also may be drawn from the permanent log 156 to be supplied to the data selector 154 for display. Accordingly, the data selector 154 is connected to a display unit 160 which may take the form of a cathode ray apparatus. The data selector 154 also is connected to a terminal keyboard apparatus 162 along with a data word generator 164. Pattern detection logic 163 is coupled to the common bus 165 and to the generator 164.

In the operation of the central station unit CS, data words are received and decoded or changed in format by the decoder 152. Routinely, such data is then logged in the permanent log 156. Alternatively, the data may be accepted directly by the data selector 154 as for exhibition by the display unit 160. Data also may be displayed either as generated by the terminal 162 or drawn from the log 156. Output data words as in the form of instructions or the like are formulated by the terminal 162 (likely with display) and formatted in the generator 164 for transmission over the conductor 148. Accordingly, data words are received and transmitted by the control station unit CS to accomplish the operations as described in detail above. The pattern detection logic 163 detects threatening patterns as described above. Such detection actuates the generator 164 to command defensive action.

Another security measure involves clearing access codes from memories M1—Mn (FIG. 3) when such codes become obsolete. For example, when a guest checks out of a hotel, it is prudent to promptly clear his individual access code. In that regard, the system of the present invention not only clears the obsolete access code, but additionally stores digits that cannot be generated at the access unit. Specifically, vacant memories M1—Mn store a series of "impossible" digits for comparison. The impossible digits are hexidecimal digit D in the hexidecimal code. The access keypads at the access units are not capable of forming such signal representations.

Selectively clearing the memories M1—Mn in the register 23 at the access units is accomplished by the terminal 162 to form a data word with an access code that constitutes representations for ten hexidecimal digits D in the field FA3 (FIG. 2A). For example, when a guest checks out of the illustrative hotel described herein, his access code is promptly cleared by a person using the terminal 162 to form a data word:

| Field | Format | Representation |
|---|---|---|
| FA1 | Source | Central code unit |
| FA2 | Destination | Vacated-room access unit |
| FA3 | Access code | DDD-D (impossible digits). |
| FA4 | User I.D. | Guest |
| FA5 | Flag | Departed |
| FA6 | Time | Time |

The data word formed in the generator 164 (FIG. 5) is communicated to the addressed access unit. For example, assume the designation is access unit A1 (FIG. 3). The series of impossible digits (hexidecimal D) are accordingly registered in the memory M1. Consequently the access code of the departed guest is replaced with impossible digits that cannot be generated by the keypad 24. Thus, as with other aspects of the present system, a considerable measure of safety is afforded.

From the above description it will be apparent that the system of the present invention affords an effective means for controlling access to individual doors or entry points in a facility. The system uses an effective method of communication, incorporates apparatus for detecting suspicious patterns, utilizes group logic with respect to individual access points and provides effective control by requiring manual action at an individual entry to open a door. Of course, the system may be implemented in a wide variety of different configurations and as a consequence, the scope hereof should be determined in accordance with the claims as set forth below.

What is claimed is:

1. A security system for use in a complex including a central control location and a plurality of floors, or other forms of contiguous space, each floor comprising a plurality of lockable access locations, said system comprising:

control apparatus including control memory means at said control location for forming test access code signals;

a plurality of access units at said access locations including actuator means for providing entry access code signals, storage means for storing said test access code signals from said control apparatus, comparison means for comparing said test access code signals from said storage means and entry access code signals provided from said actuator means to provide an entry signal solely on the occurrence of a proper comparison between said test access code signals and said entry access code signals, as to release a lockable access and further, said comparison means to provide an error signal on the occurrence of a lack of a proper comparison;

floor unit isolation means at said floors including floor memory means for test access code signals and receive-transmit means;

first data bus communication means coupling select of said access units to said floor unit isolation means for communicating data words between select of said access units and said floor unit isolation means; and second data bus communication means coupling said floor unit isolation means to said control apparatus for communicating data words between said floor unit isolation means and said control apparatus whereby said first and second communication means store test access code signals from said control apparatus in the storage means of a specified access unit.

2. A security system according to claim 1 wherein said access units further include means to provide an error signal in the event of a lack of proper comparison and wherein said error signals are stored in said floor unit isolation means.

3. A security system according to claim 1 wherein said floor unit isolation means further includes logic means for inhibiting said entry signal from releasing said lockable access at least for a predetermined interval, upon the occurrence of a predetermined number of said error signals within a predetermined time.

4. A security system according to claim 3 wherein said predetermined number of error signals within a predetermined time to inhibit said entry signal must originate from a single access unit.

5. A security system according to claim 1 wherein said floor unit isolation means stores test access code signals for said select access units coupled to said floor unit isolation means whereby test access code signals may be registered in said storage means of select of said access units from said floor unit isolation means.

6. A security system according to claim 1 wherein said access units are coupled to doors at said access locations and wherein said access units further include means for providing an open door signal when a door coupled thereto is open, and wherein said open door signals are selectively communicated to said control apparatus.

* * * * *